US010316707B2

(12) United States Patent
Weber

(10) Patent No.: US 10,316,707 B2
(45) Date of Patent: Jun. 11, 2019

(54) OUTPUT ELEMENT OF A CAMSHAFT ADJUSTER HAVING A PARTIAL STRUCTURING ON THE CONTACT SURFACE TO THE CAMSHAFT

(71) Applicant: Schaeffler Technologies AG & Co. KG, Herzogenaurach (DE)

(72) Inventor: Juergen Weber, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 60 days.

(21) Appl. No.: 15/497,476

(22) Filed: Apr. 26, 2017

(65) Prior Publication Data

US 2017/0314426 A1 Nov. 2, 2017

(30) Foreign Application Priority Data

Apr. 27, 2016 (DE) ..... 10 2016 207 180

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 1/047* (2013.01); *F01L 2001/34423* (2013.01); *F01L 2103/01* (2013.01); *F01L 2250/02* (2013.01); *F01L 2250/04* (2013.01); *F01L 2250/06* (2013.01); *F01L 2800/18* (2013.01)

(58) Field of Classification Search
CPC ..... F01L 1/047; F01L 1/3442; F01L 2001/34423; F01L 2103/01
USPC ..... 123/90.15, 90.17
See application file for complete search history.

(56) References Cited

U.S. PATENT DOCUMENTS

| | | | | |
|---|---|---|---|---|
| 7,472,467 | B2 | 1/2009 | Abeln et al. | |
| 7,866,289 | B2 * | 1/2011 | Grunow | F01L 1/3442 123/90.15 |
| 8,453,616 | B2 | 6/2013 | Eimert | |
| 8,794,201 | B2 | 8/2014 | Eimert | |
| 2016/0003110 | A1 | 1/2016 | Brenner et al. | |

FOREIGN PATENT DOCUMENTS

| | | |
|---|---|---|
| DE | 10 2005 062 522 A1 | 6/2007 |
| DE | 10 2009 050 779 A1 | 4/2011 |
| DE | 102011014460 | 9/2012 |
| DE | 102013203245 | 8/2014 |

(Continued)

*Primary Examiner* — Ching Chang
(74) *Attorney, Agent, or Firm* — Davidson, Davidson & Kappel, LLC

(57) ABSTRACT

An output element (1) of a camshaft adjuster (8) is described, in which the output element (1) has a contact surface (2) for rotatably fixed connection to a camshaft; the contact surface (2) has at least one outlet port (3) of an oil channel (4) of the output element (1), which may be situated opposite an outlet port of an oil channel of the camshaft in order to conduct hydraulic medium from the camshaft into the output element (1); the contact surface (2) has a structuring (6) in order to increase the torque transmission between the output element (1) and the camshaft; this structuring (6) is structure-free in the area (5) around the outlet port (3) and this area (5) is designed for sealing the outlet port (3) with respect to the surrounding environment.

15 Claims, 5 Drawing Sheets

(56) References Cited

FOREIGN PATENT DOCUMENTS

| | | |
|---|---|---|
| DE | 102013213927 | 1/2015 |
| DE | 102014112808 | 3/2016 |
| DE | 102014219558 | 3/2016 |

* cited by examiner

OUTPUT ELEMENT OF A CAMSHAFT ADJUSTER HAVING A PARTIAL STRUCTURING ON THE CONTACT SURFACE TO THE CAMSHAFT

This claims the benefit of German Patent Application DE102016207180.7, filed Apr. 27, 2016 and hereby incorporated by reference herein.

The present invention relates to an output element of a camshaft adjuster, which has a partial structuring on the contact surface to the camshaft in order to increase the transmittable torque, the structure-free area sealing an outlet port of an oil channel.

BACKGROUND

Camshaft adjusters are used in internal combustion engines to vary the timings of the combustion chamber valves in order to make it possible to vary the phase relationship between a crankshaft and a camshaft in a defined angle range, between a maximum early position and a maximum late position. Adapting the timings to the instantaneous load and speed lowers the consumption and the emissions. For this purpose, camshaft adjusters are integrated into a drivetrain, via which a torque is transmitted from the crankshaft to the camshaft. This drivetrain may be designed for example as a belt drive, a chain drive or a gear wheel drive.

In a hydraulic camshaft adjuster, the output element and the drive element form one or multiple pairs of pressure chambers acting in opposition, to which hydraulic medium may be applied. The drive element and the output element are arranged coaxially. By filling and emptying individual pressure chambers, a relative movement between the drive element and the output element is generated. The spring acting rotatively between the drive element and the output element pushes the drive element into an advantageous direction relative to the output element. This advantageous direction may be in the same direction or in the opposite direction with respect to the direction of rotation.

One type of hydraulic camshaft adjuster is the vane cell adjuster. The vane cell adjuster includes a stator, a rotor and a drive wheel with external teeth. As the output element, the rotor is usually designed to be rotatably fixedly connectable to the camshaft. The drive element includes the stator and the drive wheel. The stator and the drive wheel are rotatably fixedly connected to each other or, as an alternative, are formed in one piece with each other. The rotor is arranged coaxially to the stator and arranged inside the stator. The rotor and the stator form, with their radially extending vanes, oil chambers which act in opposition and to which oil pressure may be applied, and enable a relative rotation between the stator and the rotor. The vanes are either formed in one piece with the rotor and the stator or are arranged as "inserted vanes" in grooves provided for this purpose in the rotor and the stator. In addition, the vane cell adjusters have various sealing covers. The stator and the sealing covers are secured to each other via multiple screw connections.

Another type of hydraulic camshaft adjuster is the axial piston adjuster. In this case, a displacement element is displaced axially by way of oil pressure, and generates a relative rotation between a drive element and an output element via helical toothings.

Another type of camshaft adjuster is the electromechanical camshaft adjuster, which includes a triple shaft gear (for example a planetary gear). In this case, one of the shafts forms the drive element and a second shaft forms the output element. Via the third shaft, rotational energy may be supplied to or discharged from the system with the aid of an actuator, for example an electric motor or a brake. A spring may additionally be provided, which assists or returns the relative rotation between the drive element and the output element.

DE 10 2005 062 522 A1 describes a method for the force-fitting connection of the end faces of two machine components in order to transmit high torques or transverse forces, as well as an assembly formed of these machine components which is produced according to this method. Force-fitting connections between two surfaces of machine components are used in many areas of mechanical engineering to transmit transverse forces or torques. The transmittable force is effectuated substantially by the surface pressure and the resulting friction between the surfaces that are connected to each other. Such connections are particularly important in drive technology, for example for driving ancillary units. The transmittable power is often limited by the force that may be transmitted via the contact between the two surfaces abutting against each other.

DE 10 2009 050 779 A1 describes a swivel motor camshaft adjuster including a rotor and a camshaft. A friction disk is clamped axially between this rotor and the camshaft with the aid of a central screw. This friction disk thus transmits a drive torque frictionally engaged. For swiveling the rotor in two opposite directions of rotation, at least two oil channels extend through the camshaft and a hub of the rotor. At least one oil channel is hydraulically sealed on the inside in the radial direction by an inner ring part of the friction disk and on the outside in the radial direction by an outer ring part of the friction disk.

SUMMARY OF THE INVENTION

It is an object of the present invention to provide an output element of a camshaft adjuster which is particularly easy to test for leaks of the oil channels at the point of connection to the camshaft.

The present invention provides an output element of a camshaft adjuster, wherein the output element has a contact surface for rotatably fixed connection to a camshaft, wherein the contact surface has at least one outlet port of an oil channel of the output element, which may be situated opposite an outlet port of an oil channel of the camshaft in order to conduct hydraulic medium from the camshaft into the output element. The contact surface of the output element according to the present invention has a structuring in order to increase the torque transmission between the output element and the camshaft, the contact surface being structure-free in the area around the outlet port, and this area is designed for sealing the outlet port with respect to the surrounding environment.

The contact surface of the output element is preferably an axial end face of the output element. Alternatively or in addition, this contact surface may also be a circumferential surface of a central opening of the output element.

The structuring is designed as a pattern of elevations which may be formed additionally to the production step of shaping the output element or may be integrated into the latter. The structuring is preferably formed directly on the output element and/or on the camshaft, without using an additional component having the structuring. The pattern of the structuring is preferably linear. A pattern formed of individual circles is also conceivable.

As a result, a tool placed on the structure-free area, or a contact surface formed by a peripheral component and coming in contact with that area, forms a linear or flat abutment so that a medium transmitted through these surfaces, for example oil or air, may be transmitted without losses from one component to the other component. At the same time, the transmittable torque between the two components is increased as a result of the structuring of the contact surface or the partial structuring of an area of the contact surface. In addition, the structuring is not impaired by the contact of the sealing surfaces, in particular during the test for leaks by way of a tool using air.

In one embodiment of the present invention, the structuring is a laser structuring. Advantageously, a laser structuring may be applied to the contact surface of the output element or camshaft in an inexpensive and simple manner.

One alternative to laser structuring is, for example, plasma coating, in which hard particles are applied to the surface. A direct structuring in the sintering process on an output element formed of sintered metal is also conceivable. The structuring may also be formed by a metal-cutting method. In any case, methods which increase the friction coefficient of the contact surface and which may be directly applied to or incorporated in the contact surface are conceivable.

In one advantageous embodiment, the structure-free area borders the outlet port. Advantageously, due to the bordering of the outlet port by an area which has no structuring, a largely planar contact surface is formed which may come into contact with a planar contact surface.

In one particularly preferred embodiment, the structure-free area borders the outlet port and an individual elevation of the structuring which completely borders the outlet port is present on the contact surface for sealing purposes. An improved sealing effect is thus advantageously achieved by the individual elevation which completely borders the outlet port.

In one embodiment of the present invention, the structure-free area surrounding the outlet port is set back axially with respect to the structuring. Set back in this context generally encompasses an axial offset between the area of the structuring and the structure-free area. Advantageously, a centering may thus be achieved by way of the structure-free area and/or by way of the circumferential surface of the shoulder between the two areas.

In one preferred embodiment, the structure-free area surrounding the outlet port is planar. A planar contact surface to the peripheral component, which for its part also has a planar contact surface, achieves a particularly good sealing effect and the component is particularly easy to assemble.

In a further embodiment of the present invention, the structure-free area surrounding the outlet port is conical. Due to the conical design, it is possible to achieve a good centering of the two joined components.

In one embodiment of the present invention, the structure-free area borders multiple outlet ports. Advantageously, the multiple outlet ports may be arranged on the same pitch circle and may have the same diameter. The structure-free area may thus be excluded from the production process in a particularly simple manner in order to structure the rest of the contact surface.

The arrangement according to the present invention achieves a sealing of the oil channels with respect to each other and with respect to the surrounding environment, whereby at the same time an area of the structuring ensures a high torque transmission between the output element and the camshaft.

BRIEF DESCRIPTION OF THE DRAWINGS

Exemplary embodiments of the present invention are shown in the figures.

DETAILED DESCRIPTION

Figure 1A:
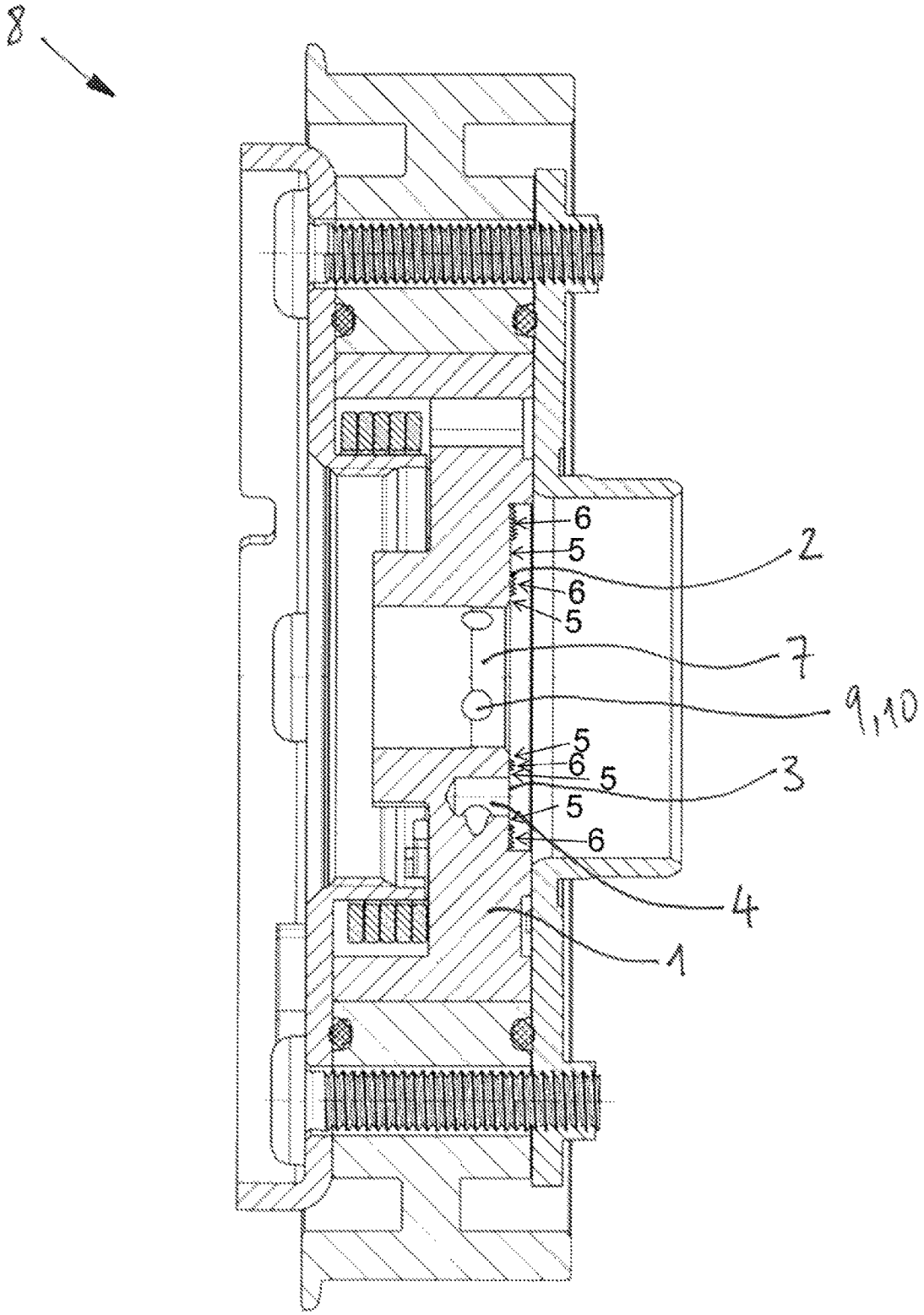
FIG. 1*a* shows a sectional view of a camshaft adjuster including an output element according to a first specific embodiment of the present invention.
Figure 1B:
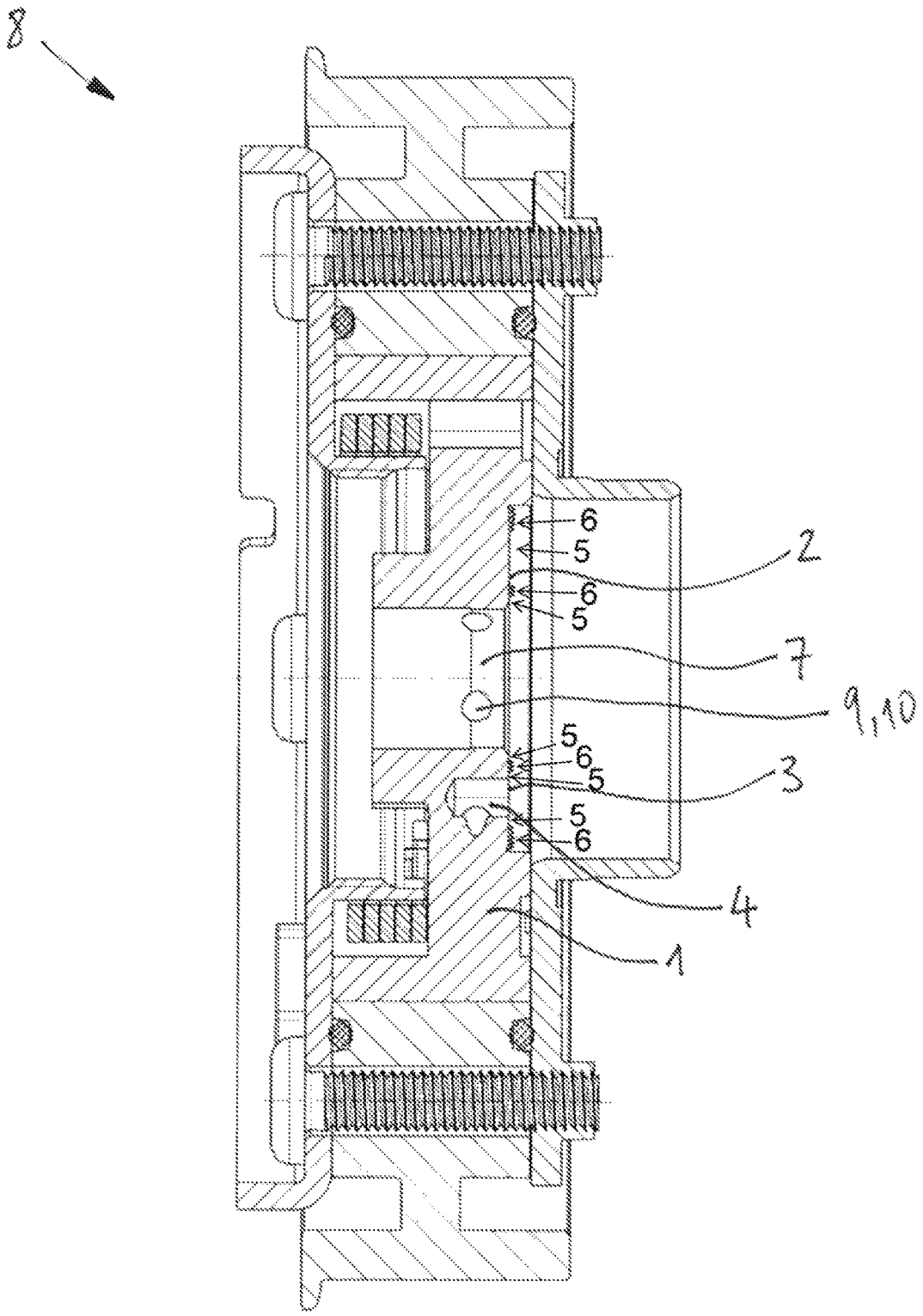
FIG. 1*b* shows a sectional view of a camshaft adjuster including an output element according to a second specific embodiment of the present invention.
Figure 4:
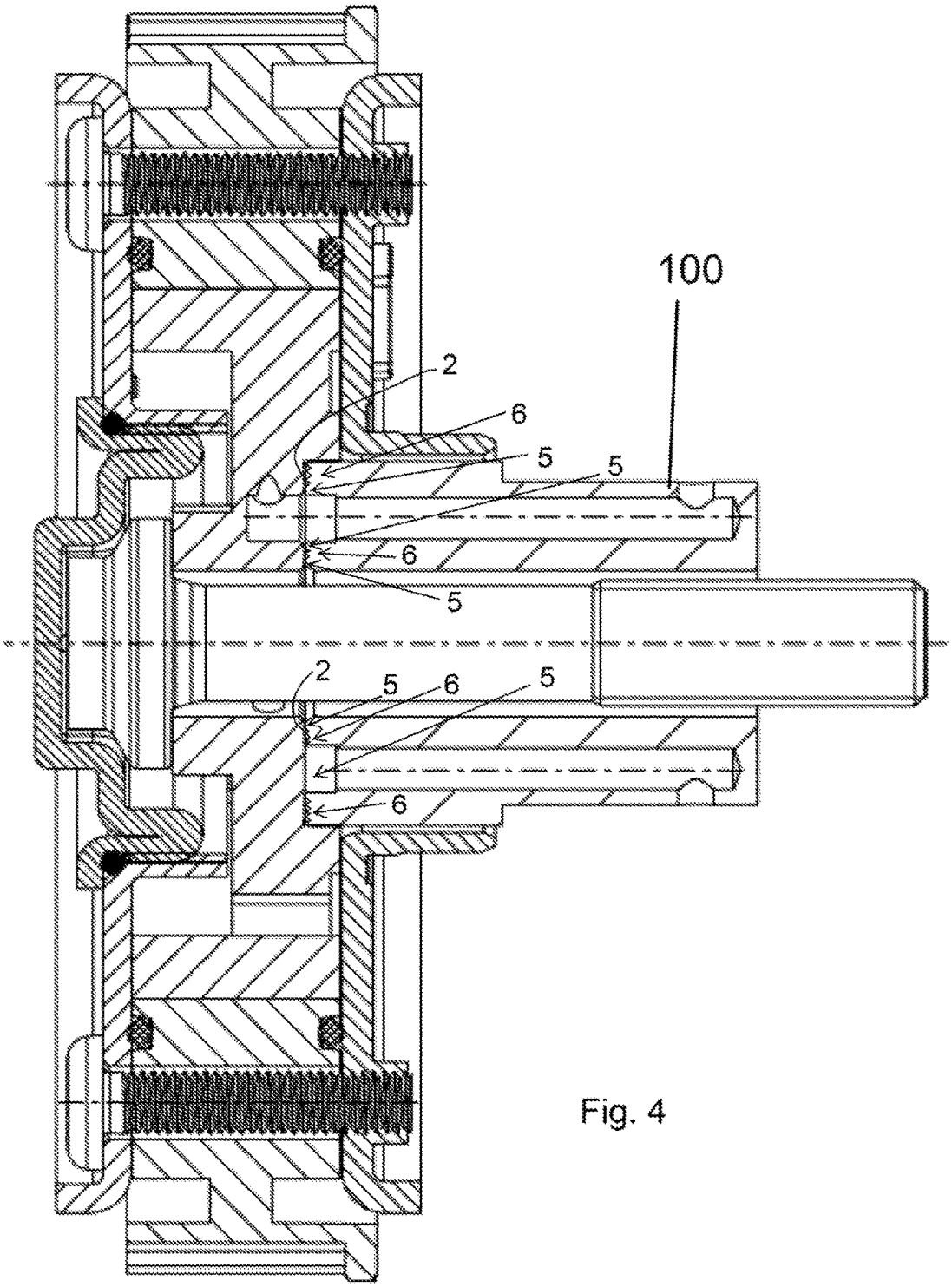
FIG. 4 shows an embodiment of the camshaft adjuster attached to the camshaft.

FIGS. 1*a* and 1*b* show sectional views of a camshaft adjuster 8 including an output element 1 according to first and second embodiments, respectively, of the present invention. The basic structure and the mode of operation of camshaft adjuster 8 are known from the prior art. Camshaft adjuster 8 and its output element 1 have an axially oriented contact surface 2 which may come in contact with an axial surface of the camshaft 100, shown in FIG. 4. Contact surface 2 has the shape of a circular ring and is penetrated centrally by a central opening 7. An oil channel 4, which extends at least partially radially within output element 1, opens with its outlet port 3 into axial contact surface 2. Outlet port 3 is circular since oil channel 4 is a bore. Axial contact surface 2 has first areas including a structuring 6 which may be in the form of a pattern of elevations and cooperates with the axial surface of the camshaft in such a way that a micro-form-fit is formed and a torque that is higher than in the prior art may be transmitted. The particular design of the structuring is described in various embodiments in the following figures. Second areas 5 that do not include structuring are also shown.

Figure 2:
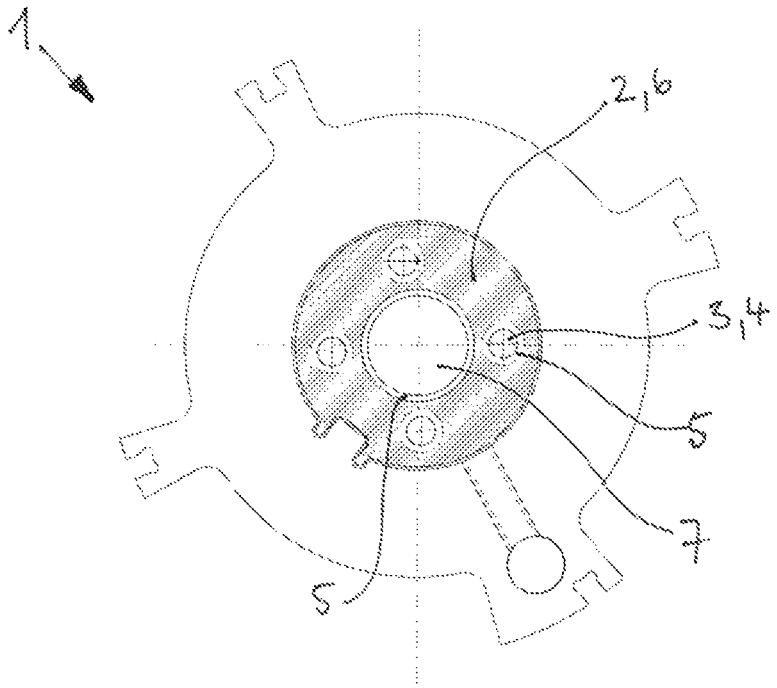
FIG. 2 shows the first specific embodiment of the output element according to the present invention, with view toward the contact surface.

FIG. 2 shows the first specific embodiment of output element 1 according to the present invention, with view toward contact surface 2. Contact surface 2 has a structuring 6 (shown as a hatched area here), which advantageously has been produced by a laser. Circular ring-shaped areas 5, which are free of the additionally applied structuring, are arranged concentrically to each outlet port 3. A tool or a surface of the camshaft may thus be placed sealingly against these exposed areas 5 and a medium (for example compressed air for testing purposes or hydraulic medium during operation of the engine) may be transmitted, the transmission being almost free of losses through the gap between the two surfaces abutting against each other.

Figure 3:
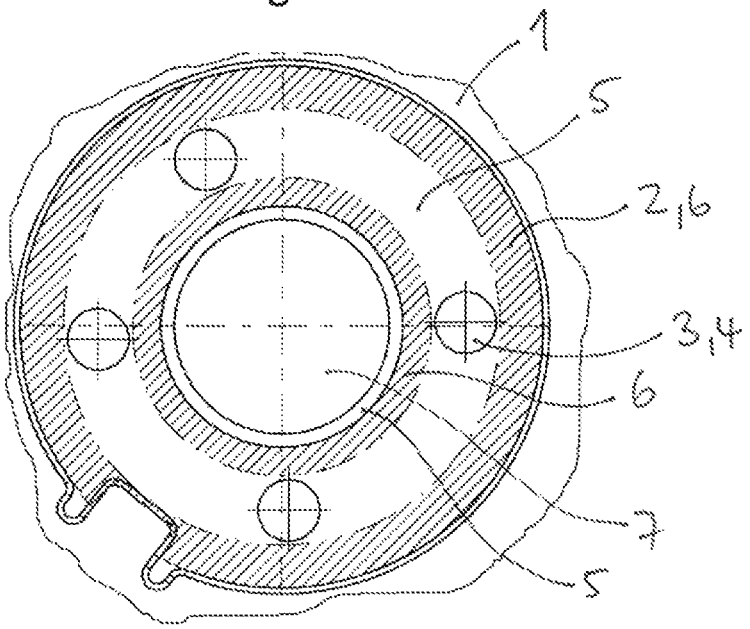
FIG. 3 shows the second specific embodiment of the output element according to the present invention, with view toward the contact surface.

FIG. 3 shows the second specific embodiment of output element 1 according to the present invention, with view toward contact surface 2. In contrast to the first specific embodiment shown in FIG. 2, structure-free area 5 borders multiple outlet ports 3 at the same time. Structure-free area 5 has the shape of a circular ring which is arranged concentrically to the axis of rotation of output element 1. A circular ring formed by structuring 6 completely encompasses structure-free area 5 and thus includes all outlet ports 3 so that a seal radially to the outside is also formed by structuring 6 in the outer area of the contact surface. In contrast, structure-free area 5 completely encompasses a smaller circular ring having a structuring 6.

FIGS. 2 and 3 have a structure-free area 5 in the shape of a circular ring adjacent to central opening 7, in order to jointly seal outlet ports 9 of radial oil channels 10 which are arranged in central opening 7.

Figure 5A:
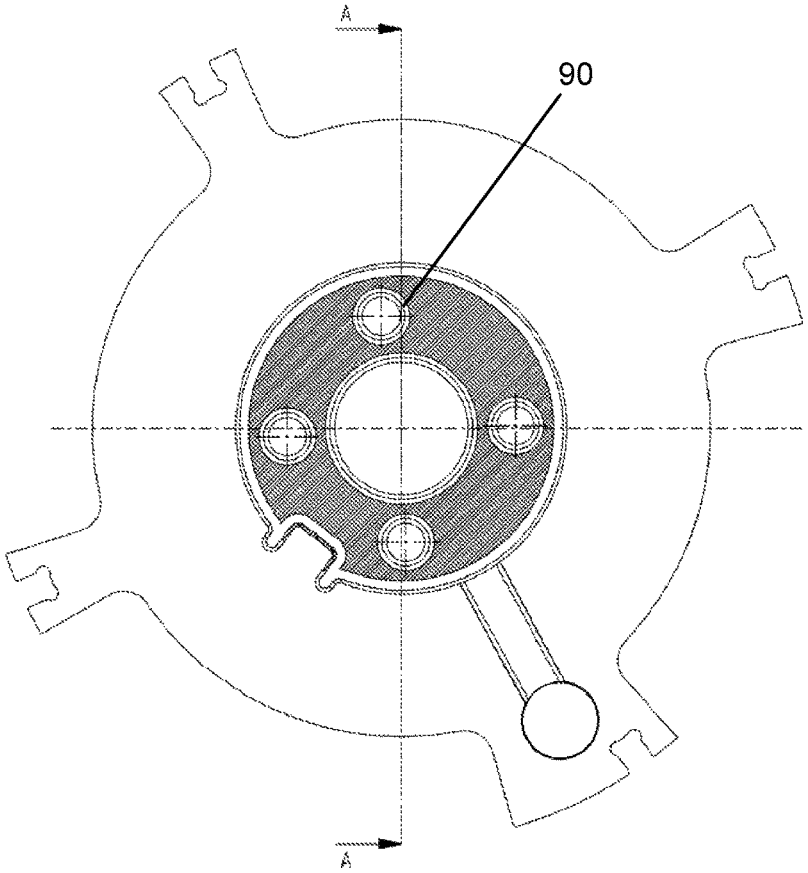
FIGS. 5*a* and 5*b* show an alternate embodiment with an individual elevation and a structure-free area surrounding the outlet port.
Figure 5B:
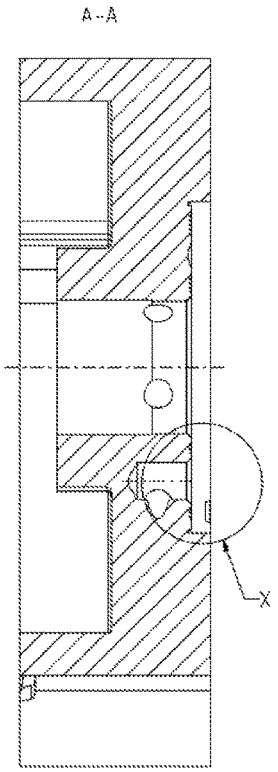

FIGS. 5*a* and 5*b* show an alternate embodiment with an individual elevation 90 and a structure-free area surrounding the outlet port. FIG. 5*b* is a cross-sectional view of A-A of FIG. 5*a*.

LIST OF REFERENCE NUMERALS

1) output element
2) contact surface
3) outlet port (axial oil channel)
4) axial oil channel of the output element
5) structure-free area
6) structuring
7) central opening
8) camshaft adjuster
9) outlet port (radial oil channel)
10) radial oil channel of the output element
90) elevation
100) camshaft

What is claimed is:

1. An output element of a camshaft adjuster comprising:

a contact surface for rotatably fixed connection to a camshaft, the contact surface having at least one outlet port of an oil channel of the output element, the at least one outlet port of the oil channel of the output element situatable opposite at least one camshaft outlet port of a camshaft oil channel of the camshaft in order to conduct hydraulic medium from the camshaft into the output element;

the contact surface having a first area including a pattern of elevations configured for engaging the camshaft for torque transmission between the output element and the camshaft, the contact surface having a second area not including the pattern of elevations and surrounding the at least one outlet port of the oil channel of the output element, and the second area being designed for contacting a further part for forming a seal around the at least one outlet port of the oil channel of the output element.

2. The output element as recited in claim 1 wherein the pattern of elevations is a laser structuring.

3. The output element as recited in claim 1 wherein the second area borders the at least one outlet port of the oil channel of the output element.

4. The output element as recited in claim 1 wherein one individual elevation of the pattern of elevations completely borders the at least one outlet port of the oil channel of the output element.

5. The output element as recited in claim 1 wherein the second area is set back axially with respect to the pattern of elevations.

6. The output element as recited in claim 1 wherein the second area is planar.

7. The output element as recited in claim 1 wherein the second area is conical.

8. The output element as recited in claim 1 wherein the at least one outlet port of the oil channel of the output element is multiple outlet ports and the second area borders the multiple outlet ports.

9. The output element as recited in claim 8 wherein the second area includes a multiple rings, each of the multiple rings surrounding a different one of the multiple ports.

10. The output element as recited in claim 9 wherein the first area surrounds all of the multiple rings.

11. The output element as recited in claim 8 wherein the second area includes a first ring surrounding all of the multiple ports.

12. The output element as recited in claim 11 wherein the first area includes a second ring radially outside of the first ring and a third ring radially inside of the first ring.

13. The output element as recited in claim 12 wherein the second area includes a fourth ring radially inside of the third ring, the fourth ring surrounding a central opening of the contact surface.

14. The output element as recited in claim 1 wherein the at least outlet port of the oil channel of the output element includes a first outlet port, the first area including a ring surrounding the first outlet port.

15. An output element of a camshaft adjuster comprising:

a contact surface for rotatably fixed connection to a camshaft, the contact surface having a central opening and an axial outlet port of an oil channel of the output element, the axial outlet port of the oil channel of the output element configured to be situated opposite a camshaft outlet port of a camshaft oil channel of the camshaft in order to conduct hydraulic medium from the camshaft into the output element;

the contact surface having a first area including a pattern of elevations configured for engaging the camshaft for torque transmission between the output element and the camshaft, and the contact surface further having a second area not including the pattern of elevations surrounding the axial outlet port of the oil channel of the output element, the second area being designed for contacting the camshaft for forming a seal around the outlet port of the oil channel of the output element; and a third area not including the pattern of elevations in the shape of a circular ring adjacent to the central opening and configured to contact the camshaft for forming a seal around a radial outlet port arranged in the central opening.

* * * * *